US008221554B2

(12) United States Patent
Thiyagarajan

(10) Patent No.: US 8,221,554 B2
(45) Date of Patent: Jul. 17, 2012

(54) FILTERING METHOD AND RELATED DISHWASHER

(75) Inventor: Ramasamy Thiyagarajan, Pondicherry (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/986,410

(22) Filed: Jan. 7, 2011

(65) Prior Publication Data

US 2012/0048300 A1 Mar. 1, 2012

(51) Int. Cl.
*B08B 3/02* (2006.01)

(52) U.S. Cl. ..... 134/10; 134/111; 134/186

(58) Field of Classification Search ..... 134/110, 134/111, 10; 210/356
See application file for complete search history.

(56) References Cited

U.S. PATENT DOCUMENTS

| | | | | | |
|---|---|---|---|---|---|
| 2,271,814 | A | * | 2/1942 | Coolidge | 210/333.1 |
| 3,122,148 | A | | 2/1964 | Alabaster | |
| 3,259,764 | A | * | 7/1966 | Kendt | 307/141 |
| 3,402,576 | A | * | 9/1968 | Krupsky | 68/4 |
| 3,451,400 | A | * | 6/1969 | Cushing | 134/58 D |
| 3,681,947 | A | * | 8/1972 | Cowan | 68/18 F |
| 3,727,435 | A | * | 4/1973 | Menk | 68/18 F |
| 3,774,418 | A | * | 11/1973 | Ohmann | 68/18 F |
| 4,559,959 | A | | 12/1985 | Meyers | |
| 4,730,630 | A | * | 3/1988 | Ranft | 134/111 |
| 5,285,664 | A | * | 2/1994 | Chang et al. | 68/18 F |
| 5,417,855 | A | * | 5/1995 | Gershenson | 210/315 |
| 5,429,679 | A | | 7/1995 | Young, Jr. | |
| 5,493,745 | A | * | 2/1996 | Hauch | 8/158 |
| 5,579,790 | A | * | 12/1996 | Edwards et al. | 134/104.1 |
| 5,755,962 | A | * | 5/1998 | Gershenson et al. | 210/452 |
| 6,402,962 | B1 | * | 6/2002 | Bruntz et al. | 210/739 |
| 6,622,754 | B1 | * | 9/2003 | Roth et al. | 134/18 |
| 6,782,899 | B2 | * | 8/2004 | Kim et al. | 134/104.1 |
| 6,896,798 | B2 | * | 5/2005 | Dover et al. | 210/170.02 |
| 7,387,688 | B2 | * | 6/2008 | Jung et al. | 134/18 |
| 2006/0237035 | A1 | * | 10/2006 | Ferguson et al. | 134/10 |

FOREIGN PATENT DOCUMENTS

| | | | |
|---|---|---|---|
| DE | 100 46 349 | * | 3/2002 |
| GB | 2 348 117 | * | 9/2000 |
| JP | 09-248267 | * | 9/1997 |

* cited by examiner

*Primary Examiner* — Frankie L Stinson
(74) *Attorney, Agent, or Firm* — Dority & Manning, P.A.

(57) ABSTRACT

A method of operating a dishwasher containing a volume of liquid for prewashing includes the steps of spraying items in the dishwasher by operating a circulation pump assembly to achieve prewashing with only the volume of liquid; filtering the volume of liquid with a filter assembly to remove particles from the items by operating the circulation pump assembly; and flushing the particles out of the filter assembly using at least some of the volume liquid by operating a drain pump assembly. Related filter assemblies and dishwasher designs are also disclosed.

20 Claims, 5 Drawing Sheets

FILTERING METHOD AND RELATED DISHWASHER

FIELD OF THE INVENTION

The present disclosure relates generally to filter systems which can be used in a dishwasher.

BACKGROUND OF THE INVENTION

Dishwashers of various types have been proposed wherein items are placed in a wash chamber which is filled and emptied according to desired wash sequences. Recently, dishwasher manufacturers have focused even more on efficiency in implementing new designs. Thus, an amount of electricity, an amount of detergent, and an amount of water used are all monitored in an attempt to provide efficient and environmentally sensitive machines.

Typically, a dishwasher goes through one or more pre-wash cycles to clean food particles, grease, etc. from the items in the dishwasher before detergent is added for cleaning. During a pre-wash cycle, various sprayers in the wash chamber of the dishwasher spray water on the items in the wash chamber to loosen and remove and such debris. After each pre-wash cycle, the water used is typically pumped out of the drain to remove whatever came off the items during the pre-wash cycle. A second pre-wash cycle and sometimes a third pre-wash cycle are then utilized with new water to further remove items before washing starts with detergent.

Each prewash cycle can use up to a gallon of water or more. Therefore, reducing the amount of cycles and/or re-using the water would be desirable. However, reusing the water in current machines would re-introduce the debris removed in a previous pre-wash cycle, thereby defeating the purposes of the pre-wash cycle.

Accordingly, other designs for filtering devices and related dishwashers and methods of operation, including those addressing one or more drawbacks of conventional devices and dishwashers would be welcome.

BRIEF DESCRIPTION OF THE INVENTION

Aspects and advantages of the invention will be set forth in part in the following description, or may be obvious from the description, or may be learned through practice of the invention.

According to certain aspects of the present disclosure a dishwasher is disclosed with an efficient prewash function including a cabinet for holding items to be washed, a wash compartment in the cabinet having a sump for collecting liquid, and at least one spray assembly for spraying a liquid into the cabinet. A circulation pump assembly circulates the liquid from the sump to and through the spray assembly into the wash compartment for prewashing, and a drain pump assembly pumps the liquid from the sump out of a drain after prewashing is completed. A controller communicates with the circulation and drain pump assemblies for directing liquid flow path and direction. A filter assembly includes a housing having a first end, a second end, a passageway between the first and second ends, and a filter membrane within the passageway. The filter assembly receives a working flow for prewashing via the first end from the sump, filtering particles from the working flow via the filter membrane, and transmitting the working flow via the second end during a prewash cycle. The filter assembly receives a flushing flow after prewashing via the second end from the sump, transmitting the flushing flow through the filter membrane to flush out particles filtered from the working flow, and transmitting the flushing flow via the first end to the drain. Various options and modifications are possible.

According to certain other aspects of the disclosure, a method of operating a dishwasher containing a volume of liquid for prewashing includes the steps of spraying items in the dishwasher by operating a circulation pump assembly to achieve prewashing with only the volume of liquid; filtering the volume of liquid with a filter assembly to remove particles from the items by operating the circulation pump assembly; and flushing the particles out of the filter assembly using at least some of the volume liquid by operating a drain pump assembly. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
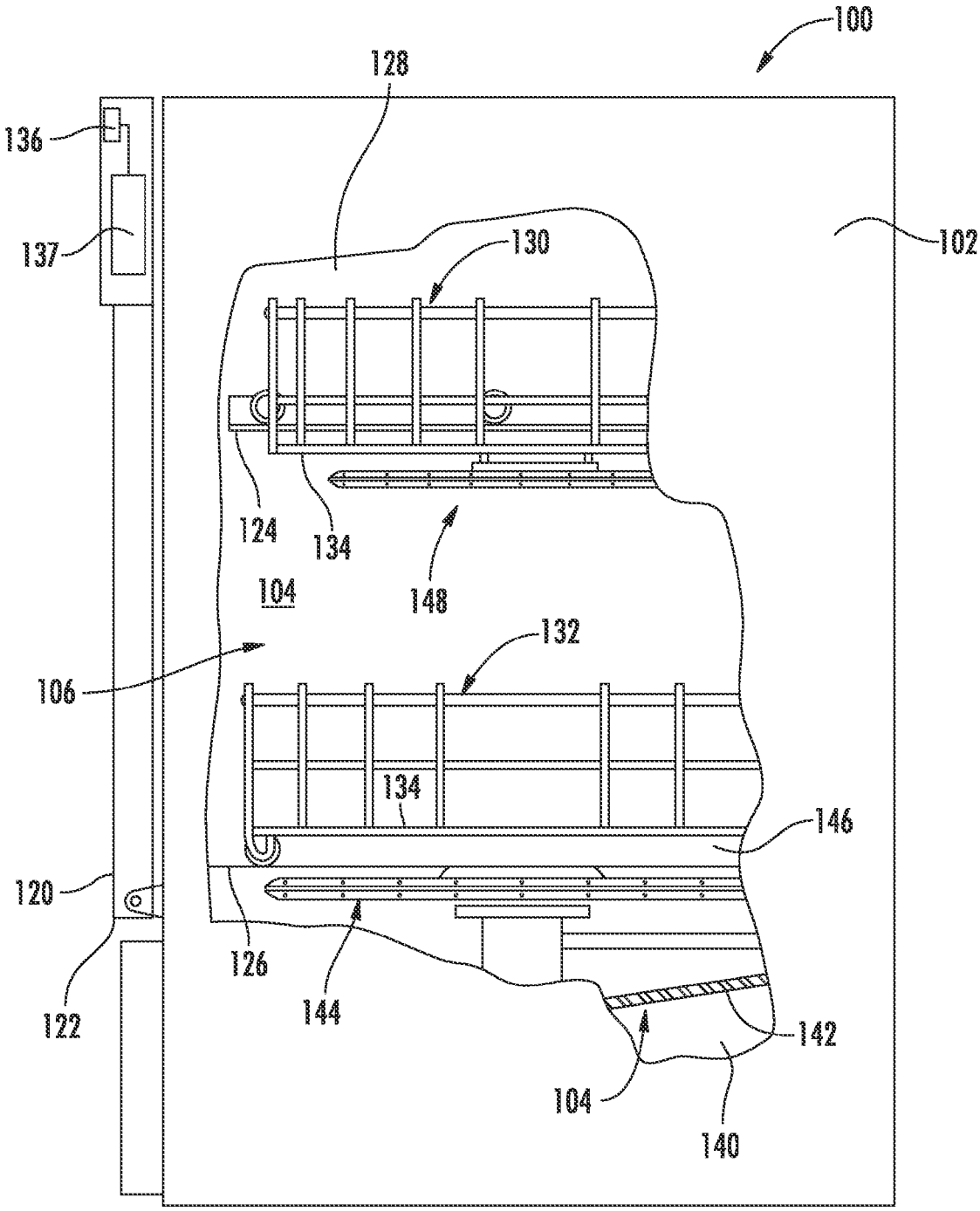
FIG. 1 provides a side partial cut-away view of an exemplary dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As discussed in greater detail below, embodiments of the present disclosure relate to a filtering system that can be used with a dishwasher. FIG. 1 depicts an exemplary domestic dishwasher 100 that may be configured in accordance with aspects of the disclosure. For the particular embodiment of FIG. 1, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles.

Figure 2:
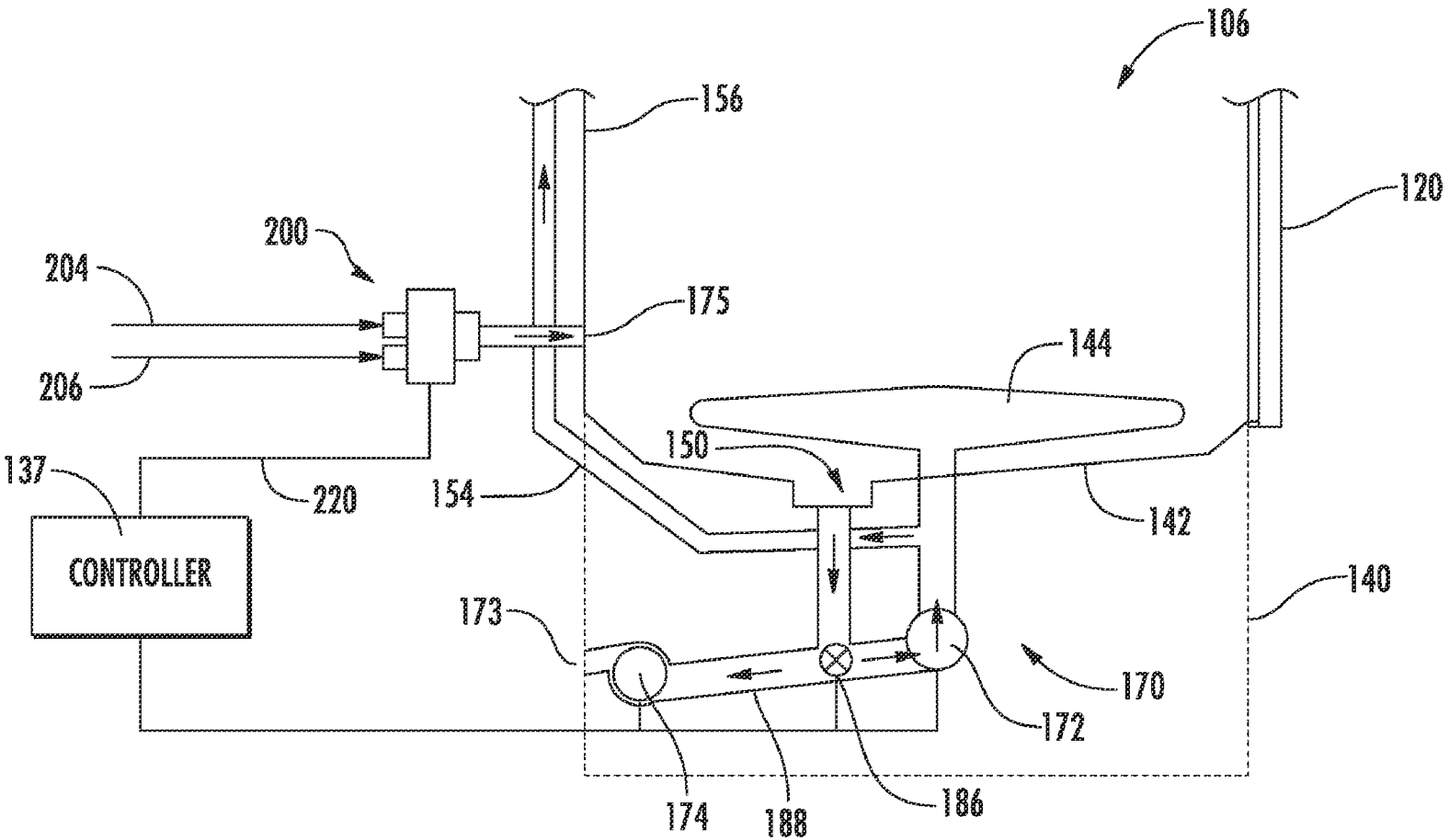
FIG. 2 is a schematic view of one possible fluid system the dishwasher of FIG. 1.

FIG. 2 schematically illustrates an embodiment of a fluid circulation assembly 170 configured below the wash chamber 106. Although one embodiment of a fluid circulation assembly that is operable to perform in accordance with aspects of the disclosure is shown, it is contemplated that other fluid circulation assembly configurations may similarly be utilized without departing from the spirit and scope of the invention. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 or other side wall of wash chamber 106, and upward along the back wall 156 for feeding wash liquid to the mid-level spray arm assembly 148 (FIG. 1) and the upper spray arm assembly. This configuration also applies to a drawer-type of dishwasher, as mentioned above.

As wash liquid is pumped through the lower spray arm assembly 144, and further delivered to the mid-level spray arm assembly 148 and the upper spray arm assembly (not shown), washing sprays are generated in the wash chamber 106, and wash liquid collects in the sump 150. The sump 150 may include a cover to prevent larger objects from entering the sump 150, such as a piece of silverware or another dishwasher item that is dropped beneath lower rack 132. A coarse filter and a fine filter (not shown) may be located adjacent the sump 150 to filter wash liquid for sediment and particles of predetermined sizes before flowing into the sump 150. Furthermore, a turbidity sensor may be coupled to the sump 150 and used to sense a level of sediment in the sump 150 and to initiate a sump purge cycle where the contents or a fractional volume of the contents of the sump 150 are discharged when a turbidity level in the sump 150 approaches a predetermined threshold. The sump 150 is filled with water through an inlet port 175 which outlets into wash chamber 106.

As shown, a drain valve 186 is established in flow communication with the sump 150 and opens or closes flow communication between the sump 150 and a drain pump inlet 188. The drain pump assembly 174 is in flow communication with the drain pump inlet 188 and may include an electric motor for pumping fluid at the inlet 188 to an external drain system via drain 173. In one embodiment, when the drain pump is energized, a negative pressure is created in the drain pump inlet 188 and the drain valve 186 is opened, allowing fluid in the sump 150 to flow into the fluid pump inlet 188 and be discharged from fluid circulation assembly 170 via the external drain 173. Alternatively, pump assemblies 172 and 174 may be connected directly to the side or the bottom of sump 150, and the pump assemblies may each include their own valving replacing drain valve 186. Other fluid circulation systems are possible as well, drawings fluid from sump 150 and providing as desired within wash chamber 106 or draining out of washing machine 100.

Referring to FIG. 2, a water supply 200 may be configured with the inlet port 175 for supplying wash liquid to the wash chamber 106. The water supply 200 may provide hot water only, cold water only, or either selectively as desired. As depicted, water supply 200 has a hot water inlet 204 that receives hot water from an external source, such as a hot water heater and a cold water input 206 that receives cold water from an external source. It should be understood that the term "water supply" is used herein to encompass any manner or combination of valves, lines or tubing, housing, and the like, and may simply comprise a conventional hot or cold water connection.

Figure 3:
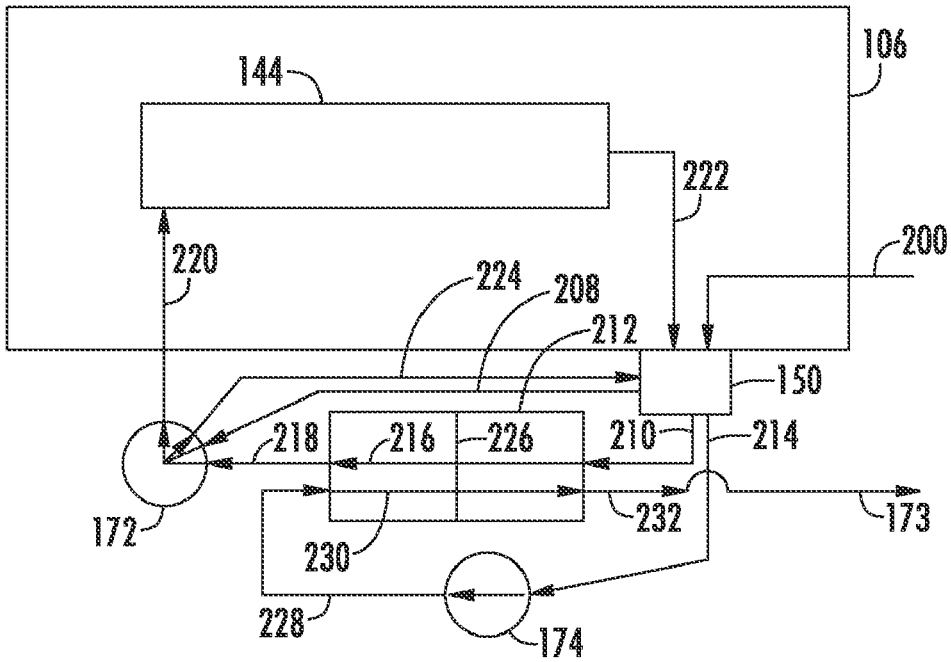
FIG. 3 provides a diagrammatical view showing the methods and flow paths used by the dishwasher according to certain aspects of the invention.

FIG. 3 shows one diagrammatical example of an operating method and structures used in certain aspect of the present disclosure. As shown, the liquid flow paths are different than found in FIG. 2. For example, wash chamber 106 has a sump 150 and a water supply 200. Sump 150 has a first outlet 208 in communication with circulation pump assembly 172, a second outlet 210 in communication with filter assembly 212 and a third outlet 214 in communication with drain pump assembly 174. It should be understood that sump 150 may instead have only one or two outlets with corresponding valving (not shown) to distribute the three flows. Liquid from sump outlet 210 follows path 216 through filter assembly 212 and exits 218 to circulation pump assembly 172.

During normal prewashing, circulation pump assembly 172 receives liquid directly from sump 150 via sump outlet 208 and pumps the liquid along one or more paths 220 to one or more spray assemblies 144 within wash chamber 106. Spray assemblies 144 spray liquid onto the contents of wash chamber 106, the liquid following various paths 222 back to sump. Particles from the items placed in the wash chamber 106 for washing collect in the liquid.

However, during a filtering portion of the prewashing, circulation pump assembly 172 sends liquid received from filter assembly 212 along a recirculation path 224 back to sump 150. Liquid leaves sump via second outlet 210 and passes through a filter membrane 226 in filter assembly 212 back to circulation pump assembly 172.

Dishwasher 100 can accordingly operate a first prewash cycle for a conventional duration, followed by a filtration cycle using the same prewash liquid. After filtration cycle, most particles will be removed from the liquid, and the same liquid can be used for a second prewash. Again, the second prewash cycle can be run for a conventional amount of time. Typically, some additional particles are generated during a second prewash, although the amount is generally reduced. Another, filtration cycle can then be run to again reduce the amount of particles in the liquid. If desired, a third prewash cycle can then be run, again using the same liquid.

Once sufficient prewashing cycles have been completed, the liquid in sump 150 can be drained via third outlet 214 using drain pump assembly 174 which passes liquid 228 to filter assembly 212. The liquid follows path 230 through filter assembly 212 and filter membrane 226, passing out of the filter along path 232 out the external drain 173. When this flushing cycle is performed, the particles previously trapped by filter membrane 226 are flushed out of external drain. However, only one flush cycle need be performed even though multiple prewash cycles have been performed, thereby conserving water as compared to conventional devices.

Accordingly, two or more prewash cycles can be run using the same original supply of liquid. Since a prewash cycle may use up to a gallon or more of liquid per cycle, substantial savings on water usage can be achieved by reusing liquid during successive prewash cycles in this fashion.

Figure 4:
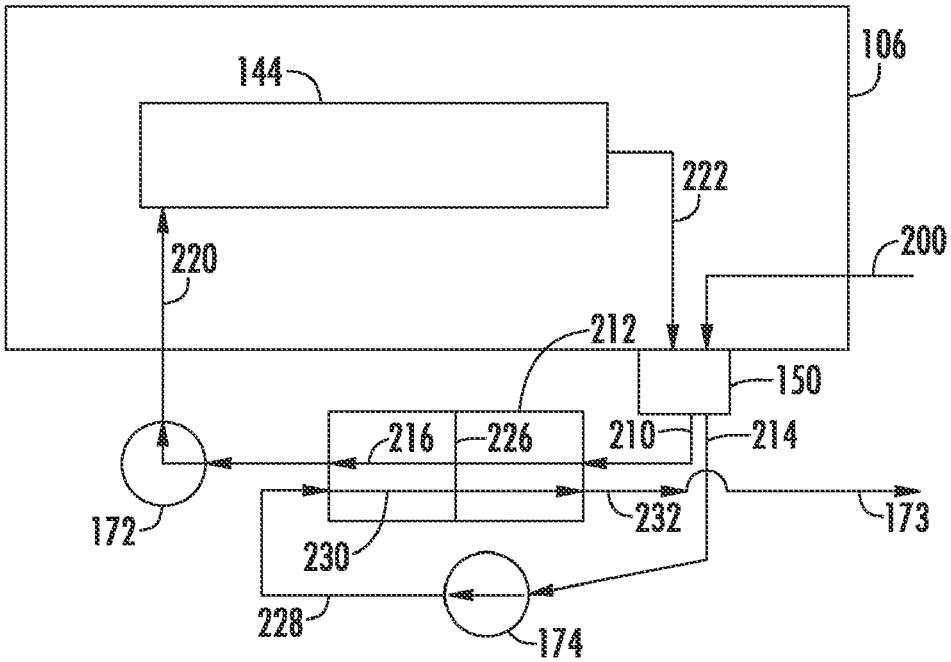
FIG. 4 provides a diagrammatical view showing the methods and flow paths used by the dishwasher according to other aspects of the invention.

FIG. 4 shows a modified version of the cycles and structures shown in FIG. 3, in which alternating filtration and prewash spraying are not used. Instead, filter assembly is kept in-line at all items during prewash spraying by spray assemblies 144. Bypass conduits 208 and 224 are thus not needed in FIG. 4.

Instead, flow out of sump 150 during prewashing always goes through filter assembly 212 to circulation pump assembly 172 and then to spray assembly 144. Due to the filtration prewashing may be performed longer than one conventional cycle, for example the duration of two or more cycles. Afterwards, drain pump assembly 174 can be used to flush filter assembly 212, as above. The cycle of FIG. 4 may be shorter in duration as filtration and prewash spraying are conducted at the same time.

Either of the cycles described above can therefore provide prewashing in an amount equivalent to at least two conventional prewash cycles with a single filling of the wash compartment with liquid. The amount of prewashing can be measured not just by time of spraying but also by the amount of a particle content remaining in the liquid. If desired, in either cycle, a sensor of various types (not shown) can determine a characteristic of the prewash liquid (such as turbidity, etc.) to estimate the particle content of the liquid. Such sensor could be located for example between the sump 150 and the filter assembly 212. Accordingly, active feedback can be provided during the prewash cycle to stop prewashing and filtration if low particle content is detected, thereby saving time and electricity. Also, it should be understood that controller 137 can manage all elements described above, including pumps, valves, sensors and any optional items or modified structures mentioned.

Figure 5:
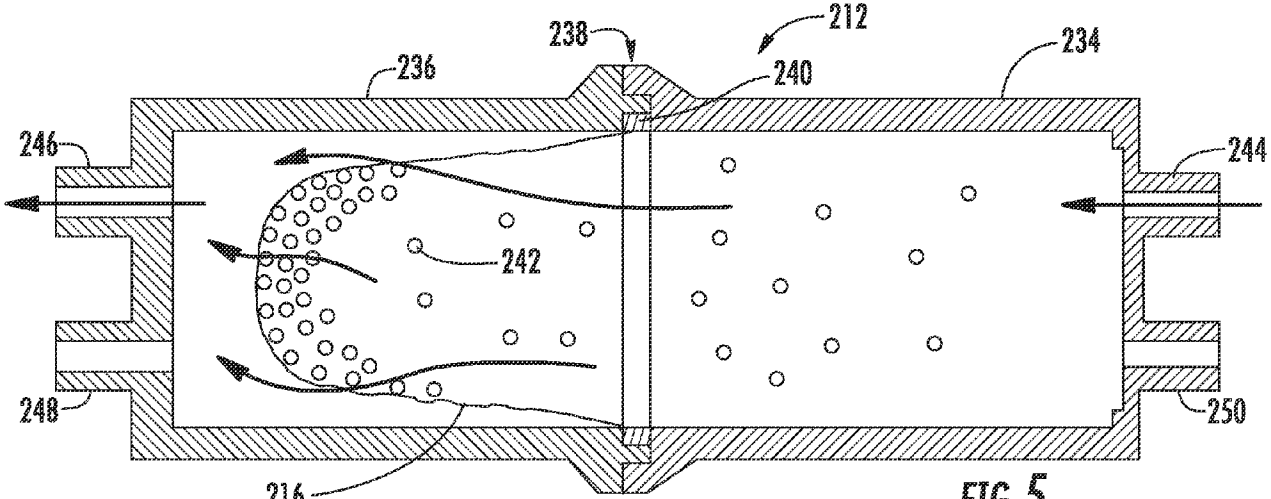
FIG. 5 provides a cross-sectional view of one example of a filter assembly according to certain aspects of the invention during filtration.
Figure 6:
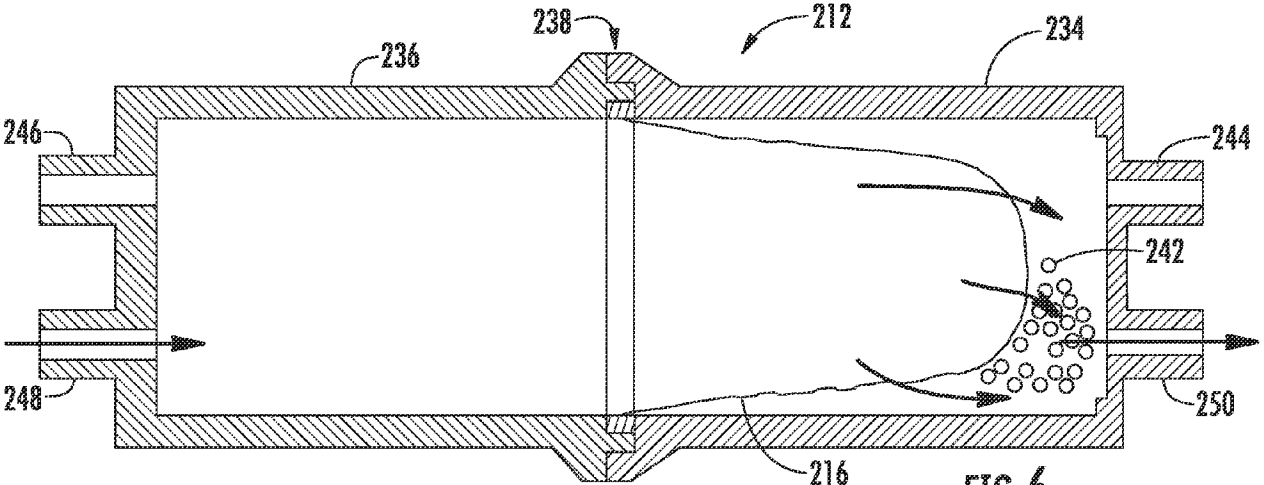
FIG. 6 provides a cross-sectional view of the filter assembly of FIG. 5 during flush.

FIGS. 5 and 6 show one example of a filter assembly 212 suitable for use with the present disclosure. As shown, assembly 212 includes two halves 234,236 joined at a central flange interface 238. Filter membrane 216 may comprise a fine nylon and/or polyester weave, mesh, or non-woven material, or any other type of fine material. The membrane 216 may have openings in the range of about 50 to about 300 microns, and may for example in one embodiment have openings of about 150 microns. Opening sizes can be different across membrane 216 as well, whereby a maximum opening size is within the ranges above.

Filter membrane 216 may be formed in a bag shape with a mounting ring 240 around the open top held in place by the flange interface area. Providing an elongated housing allows a correspondingly lengthy filter membrane 216 and larger filtration surface. FIG. 5 shows filtration, where particles 242 and liquid enter inlet 244, and the particles are substantially trapped by membrane 216. Liquid flows out of outlet 246. FIG. 6 shows flushing, where liquid flows in inlet 248, though membrane 216 and out outlet 250 taking along particles 242 collected previously.

As shown, membrane 216 can be turned inside-out by the reverse flow during the flush to remove the particles. Using a movable bag-shaped membrane, as opposed to a relatively planar membrane, a rigid membrane or screen, for example, allows for better cleaning out of the particles during flush.

Also, it should be noted that the volume of the bag-shaped membrane should be larger than the expected volume of the particles removed during the prewash. If not, the membrane could become clogged before the desired end of the prewash cycle.

Figure 7:
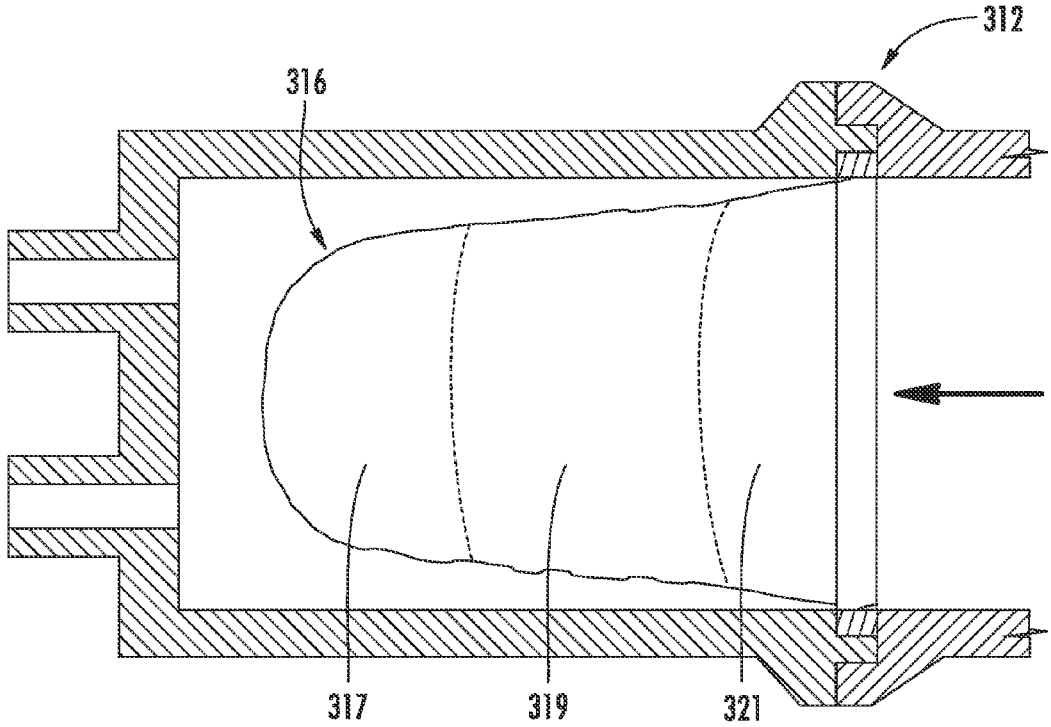
FIG. 7 shows a portion of an alternate filter assembly.

FIG. 7 shows a modified filter assembly 312 where membrane 316 includes multiple portions having different opening sizes. As shown, three portions 317, 319 and 321 are provided, each having a different maximum opening (pore) size. Accordingly, portion 317 at the distal end of membrane 316 may have a smaller opening size (such as about 100 microns), whereas portions 319 and 321 have successively larger opening sizes (about 200 and about 300 microns, respectively, in this example). Arranging the membrane with a smaller opening size toward the distal end where particles initially collect and a larger opening size toward the other end may allow for better flow through the membrane as particles accumulate.

Figure 8:
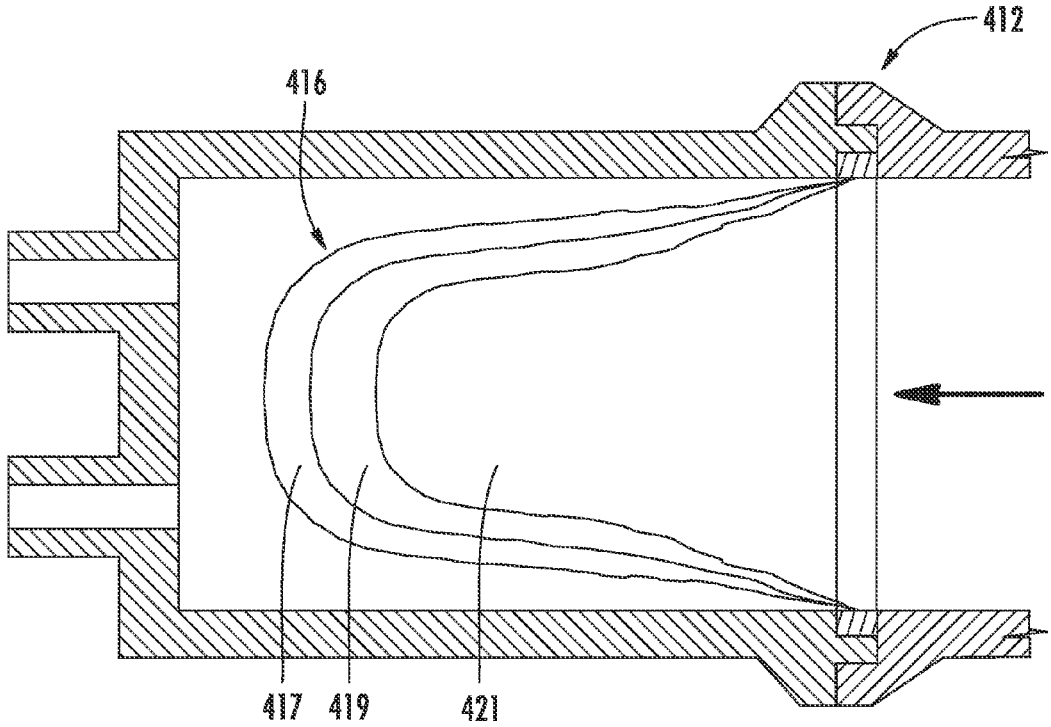
FIG. 8 shows a portion of another alternate filter assembly.

FIG. 8 shows another modified filter assembly 412 where membrane 416 includes multiple separate bag-shaped members. A shown, three such members are provided 417, 419, and 421. Member 417 is the largest and has the smallest opening size (for example 100 microns). Member 419 is smaller and has a larger opening size (for example 200 microns). Member 421 is the smallest and has the largest opening size (for example 300 microns). Using multiple sizes in separate bag-shaped members is another way to potentially avoid clogging.

It should be understood that the two approaches above (different opening sizes on one bag and multiple bags with different opening sizes) can be combined as well. Also, it should be understood that three different opening sizes and/or bags are not required. Two, or more than three, could be employed if desired. Finally, it should be understood that the particle sizes given herein are not limiting and other sizes could be used depending on the application and other characteristics of the washing machine.

It should be understood that various modifications are possible. For example, numerous variations as to the construction of the filter assembly, the arrangement of the liquid connections are possible. Also, the timing, operating, and sequencing of the prewash, filter and flush cycles could all be modified within the scope of the present invention.

In view of the above, simple and reliable methods of operating a dishwasher, as well as filtering devices for dishwashers are provided. Suing the present disclosure, substantial water and electricity savings are possible. Such filtration device can be used not only within a dishwasher but also within other devices.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher with an efficient prewash function comprising:

a cabinet for holding items to be washed;

a wash compartment in the cabinet, the wash compartment having a sump for collecting liquid;

at least one spray assembly for spraying a liquid into the cabinet;

a circulation pump assembly for circulating the liquid from the sump through a first path to and through the spray assembly into the wash compartment and back to the sump for prewashing or through a second path to and through a filter assembly and back to the sump for filtration, the first path excluding the filter assembly and the second path excluding the spray assembly;

a drain pump assembly for pumping the liquid from the sump through a third path out of a drain after prewashing and filtration are completed;

a controller in communication with the circulation and drain pump assemblies for directing liquid flow path selectively through either the first path, the second path, or the third path; and a filter assembly including a housing having a first end, a second end, and a passageway between the first and second ends, the filter assembly including a filter membrane within the passageway, the housing passageway forming a portion of the second path in a direction from the first end to the second end and forming a portion of the third path in a direction from the second end to the first end, the filter assembly receiving a working flow for prewashing via the first end from the sump, filtering particles from the working flow via the filter membrane, and transmitting the working flow via the second end during a filtering portion of a prewash cycle, the filter assembly receiving a flushing flow after prewashing via the second end, transmitting the flushing flow through the filter membrane to flush out particles filtered from the working flow, and transmitting the flushing flow via the first end to the drain.

2. The dishwasher of claim 1, wherein the controller periodically directs the circulation pump assembly to transmit the working flow through the filter assembly via the second path to permit an amount of prewashing to be conducted equivalent to at least two prewash cycles with a single filling of the wash compartment with liquid.

3. The dishwasher of claim 2, wherein the amount of prewashing is based on a particle content remaining in the liquid.

4. The dishwasher of claim 2, wherein the amount of prewashing is based on a duration of prewashing.

5. The dishwasher of claim 2, wherein the washing machine conducts an amount of prewashing equal to at least three prewash cycles.

6. The dishwasher of claim 1, wherein the controller directs the working flow to alternatingly flow through either the filter assembly via the second path or the spray assembly via the first path during the prewash cycle.

7. The dishwasher of claim 6, wherein the controller directs the working flow to flow through the filter assembly via the second path at least two times during the prewash cycle.

8. The dishwasher of claim 1, wherein the controller directs the working fluid to flow through the spray assembly and the filter assembly in series at least once during the prewash cycle.

9. The dishwasher of claim 1, wherein the filter membrane includes maximum openings of about 50 to about 250 microns.

10. The dishwasher of claim 9, wherein the filter membrane is in the form of a bag shaped member having a volume greater than that of the particles collected during working flow, the bag-shaped member being configured to be turned inside-out when flow is switched from the working flow to the flushing flow to remove the particles.

11. The dishwasher of claim 1, wherein the filter membrane includes a bag-shaped member having a distal portion having openings of a first size and a second portion having openings of a second size larger than the first size.

12. The dishwasher of claim 11, wherein the bag-shaped member includes a third portion at a proximal end having a third particle size larger than the second size.

13. The dishwasher of claim 1, wherein the filter membrane includes a first bag shaped member having a first size and a first opening size and a second bag shaped member having a second size smaller than the first size and a second opening size larger than the first opening size.

14. The dishwasher of claim 13, wherein the filter membrane includes a third bag shaped member having a third size smaller than the second size and a third opening size larger than the second opening size.

15. A method of operating a dishwasher containing a volume of liquid for prewashing, the method comprising:

spraying items in the dishwasher by operating a circulation pump assembly to achieve prewashing with only the volume of liquid, the circulation pump assembly pumping the liquid through a first path to and through the spray assembly into the wash compartment and back to the sump for prewashing;

filtering the volume of liquid with a filter assembly to remove particles from the items by operating the circulation pump assembly, the circulation pump assembly pumping the liquid through a second path to and through a filter assembly and back to the sump for filtration, the first path excluding the filter assembly and the second path excluding the spray assembly; and flushing the particles out of the filter assembly using at least some of the volume of liquid by operating a drain pump assembly to pump the liquid through a third path and out of a drain.

16. The method of claim 15, wherein the spraying and filtering steps are done alternatingly via the first and the second paths.

17. The method of claim 16, wherein the spraying and filtering steps are done at least two times using the volume of liquid.

18. The method of claim 15, wherein the spraying and filtering steps are done simultaneously at least once during prewashing.

19. The method of claim 15, wherein the filtering step is performed with a membrane in the form of a bag-shaped member.

20. The method of claim 19, wherein the bag-shaped member has a volume greater than that of the particles collected during filtering and is configured to be turned inside-out during flushing to remove the particles.

* * * * *